US005875811A

United States Patent [19]

Jacobson

[11] Patent Number: 5,875,811

[45] Date of Patent: Mar. 2, 1999

[54] COUNTERBALANCE VALVE WITH IMPROVED RELIEF PRESSURE SETTING ARRANGEMENT

[75] Inventor: Robert D. Jacobson, St. Paul, Minn.

[73] Assignee: Dana Corporation, Toledo, Ohio

[21] Appl. No.: 837,342

[22] Filed: Apr. 17, 1997

[51] Int. Cl.[6] ..... F15B 13/03

[52] U.S. Cl. ..... 137/269; 137/106; 251/25; 91/420; 91/447

[58] Field of Search ..... 137/106, 269, 137/599; 91/420, 447; 251/25, 30.03

[56] References Cited

U.S. PATENT DOCUMENTS 3,266,852 8/1966 Bueler ..... 91/447 X
4,172,582 10/1979 Bobnars et al. .
4,244,275 1/1981 Smilges .
4,461,449 7/1984 Turner .
5,309,936 5/1994 Christensen ..... 137/106
5,400,816 3/1995 Gerstenberger .

*Primary Examiner*—Kevin Lee
*Attorney, Agent, or Firm*—Millen, White, Zelano, & Branigan, P.C.

[57] ABSTRACT

In order to achieve repeatable, consistent operation of a counterbalance valve, a poppet valve element within the valve has a radial bore therein in communication with a control fluid port and an axial bore therein which receives a rod that is anchored to a poppet valve cage that surrounds the poppet valve element. The poppet valve element is urged by a spring into engagement with a valve seat and pilot pressure is applied in opposition to the spring. By virtue of this arrangement, control fluid pressure is applied via the rod directly to the valve body in which the poppet valve element and cage are mounted. By changing the diameter of the rod and axial bore through the poppet valve element which receives the rod, the relief set pressure can easily be changed.

12 Claims, 3 Drawing Sheets

COUNTERBALANCE VALVE WITH IMPROVED RELIEF PRESSURE SETTING ARRANGEMENT

FIELD OF THE INVENTION

The present invention relates to counterbalance valves and more importantly to improved relief setting arrangements for counterbalance valves.

BACKGROUND OF THE INVENTION

Hydraulically operated machines are frequently used in construction projects and other activities. Exemplary of such machines are man baskets, cranes and backhoes. Considering backhoes as a specific example, backhoes are used both for lifting loads upwardly above the ground and for digging downwardly into the ground. To accomplish this, backhoes are provided with articulated shovel assemblies which are moved by hydraulic operating systems. Such systems are provided with one or more valves which are manipulated by an operator to cause appropriate movement of the shovel assembly. For example, the shovel assembly can first be used to dig downwardly to excavate the soil where a pipeline is to be laid. Then, having removed the soil, the shovel assembly can be used to lower a length of pipe into the hole and to support it adjacent to a previously laid pipe so that the two pipes may be welded together.

The hydraulic operating systems of backhoes and similar machines typically include a source of pressurized fluid which is selectively connected to a cylinder containing a movable piston. The piston sealingly engages the inner surface of the cylinder, dividing it into first and second chambers. As is well known, by connecting the source to supply pressurized fluid to the first chamber and by simultaneously venting the second chamber, the piston can be moved in one direction relative to the cylinder. Conversely, by connecting the source to the second chamber and by venting the first chamber, the piston can be moved in the opposite direction relative to the cylinder. Lastly, by preventing fluid within both the cylinder chambers from escaping therefrom, the piston can be locked in a predetermined position within the cylinder. The piston is connected by a rod to the movable member of the machine (i.e., the shovel assembly of a backhoe) for movement therewith.

In order to control the flow of pressurized fluid to and from the cylinder chambers, a control valve is usually connected between the source of pressurized fluid and the cylinder chambers. A conventional four-way valve is frequently employed for this purpose. Such a control valve is disclosed in U.S. Pat. No. 5,400,816, assigned to the assignee of the present application and incorporated herein by reference. The four-way valve usually has three operating positions. In its first position, the four-way valve connects the source of pressurized fluid to the first chamber and vents the second chamber, causing the piston to move in one direction. In its second position, the four-way valve connects the source of pressurized fluid to the second chamber and vents the first chamber, causing the piston to move in the opposite direction. In its third position, the four-way valve prevents fluid within both of the chambers from escaping therefrom, causing the piston to be locked in a predetermined position.

In most hydraulically operated machines which perform lifting functions, a holding or counterbalance valve is connected in the hydraulic lines extending between the four-way valve and the cylinder, typically directly adjacent to the cylinder. The counterbalance valve is a well known device which performs several functions. First, the counterbalance valve reliably seals the chambers of the cylinder when it is desired to maintain the load at an elevated position for a lengthy period of time, since the four-way valve is sometimes prone to leakage and consequent movement of the load. Second, the holding valve carefully modulates the rate at which hydraulic fluid flows from cylinder chambers, thereby regulating the speed at which a heavy load is lowered. Third, the holding valve provides a static overload relief function, allowing excess pressurized fluid to escape from the system before causing damage. Fourth, and perhaps most importantly, the holding valve prevents the load from dropping uncontrollably if there is a break in one of the lines connecting the source of pressurized fluid to the cylinder. If this occurs, the holding valve prevents any hydraulic fluid from flowing in or out of the cylinder chambers, thereby locking the piston within the cylinder and preventing the load from falling.

In counterbalance valves, a differential area that controls the relief function is fixed by the manufacturer upon fabricating the cage and poppet and is subject to wide tolerances when diameters of the valve components are large. Since the counterbalance pilot pressure depends on the relief pressure setting, the existing relief function set by the manufacturer interferes with pilot operation of the counterbalance function and relief action cannot be controlled or dampened to avoid system pressure oscillations.

SUMMARY OF THE INVENTION

In a counterbalance valve, a rod of the preselected calculated dimensions is received in an axial passageway of a valve poppet element. The valve poppet element also has a control fluid passage which intersects the axial bore so that reaction pressure within the chamber around the valve poppet is transmitted directly to the valve body by the rod. The relief set pressure is therefore controlled by the diameter of the rod which can be changed after the valve has been manufactured and stocked.

Other aspects and advantages of this invention will become apparent to those skilled in the art from the following detailed description of the preferred embodiment, when read in light of the accompanying drawings.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

1) General Operation

Figure 1:
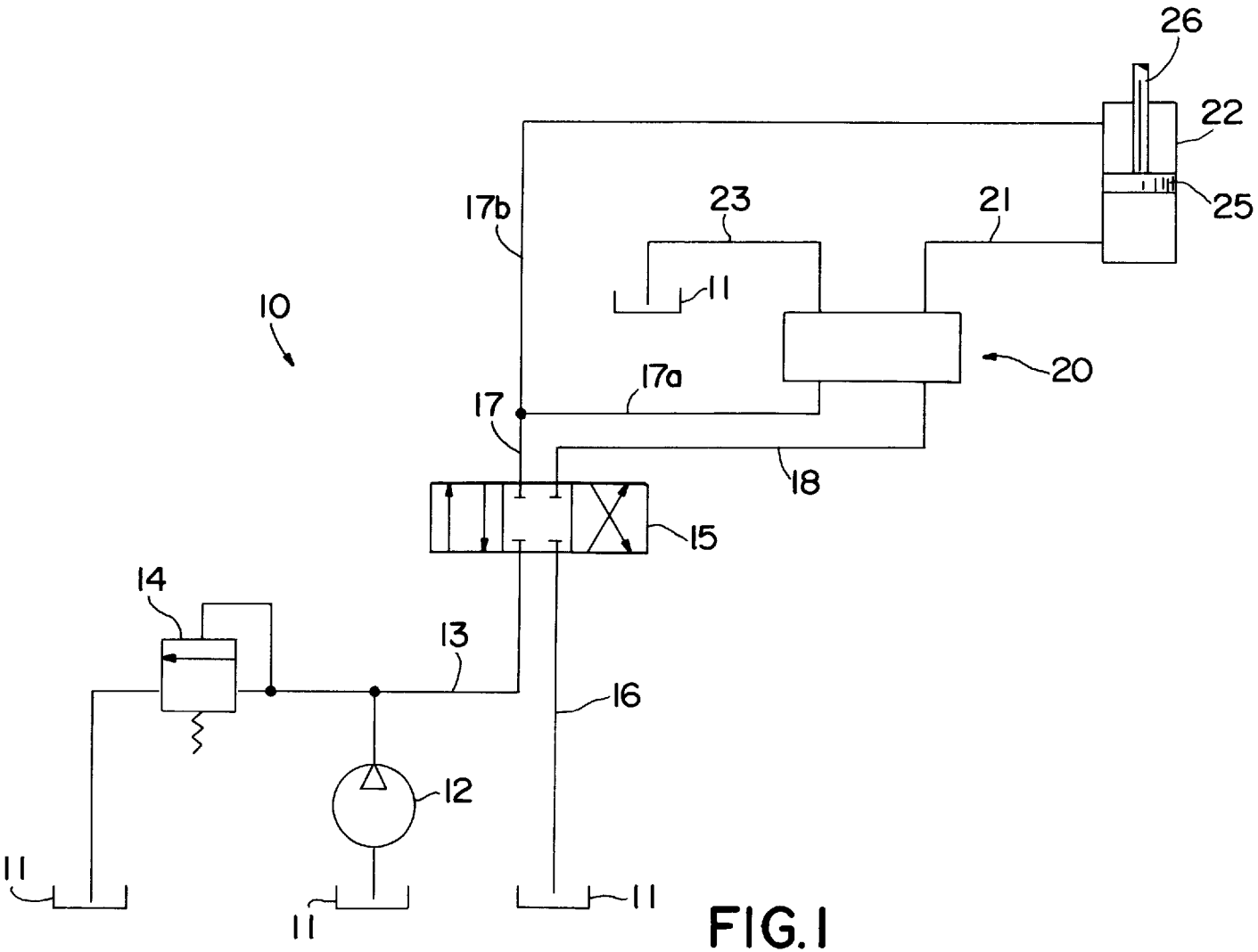
FIG. 1 is a schematic diagram of a hydraulic operating system for a machine having a movable member adapted to perform various functions, the system including an improved counterbalance valve in accordance with this invention.

Referring now to the drawings, there is illustrated in FIG. 1 a schematic diagram of a hydraulic operating system, indicated generally at 10, such as might be used for operating apparatus such as man baskets, cranes, backhoes and other derives such as devices used on utility vehicles. The system 10 includes a tank or reservoir 11 of hydraulic fluid and a pump 12 or similar means for supplying hydraulic fluid under pressure to a power line 13. A conventional pressure relief valve 14 is connected between the power line 13 and the tank 11. The power line 13 is connected to a first port of a conventional four-way control valve 15. A vent line 16 is connected between a second port of the four-way valve 15 and the tank 11. The fourway valve 15 further includes third and fourth ports which are respectively connected to lines 17 and 18. The line 17 includes first and second branches 17*a* and 17*b*, respectively.

A counterbalancing valve, indicated generally at 20, is provided in the system 10. The holding valve 20 has four ports, namely, a pilot port P, a valve port V, a cylinder port C, and a tank port T. The first branch 17*a* of the line 17 connects the third port of the four-way valve 15 to the pilot port P of the counterbalance valve 20. The line 18 connects the fourth port of the four-way valve 15 to the valve port V of the counterbalance valve 20. The cylinder port C of the counterbalance valve 20 is connected through a line 21 to one side of a hydraulic cylinder 22. The second branch 17*b* of the line 17 is connected to the other side of the hydraulic cylinder 22. The tank port T of the holding valve 20 is connected through a line 23 to the tank 11.

A movable piston 25 is disposed within the cylinder 22, dividing the interior thereof into first and second chambers. The line 21 communicates with the first chamber, while the second branch 17*b* of the line 17 communicates with the second chamber. A rod 26 is secured to the piston 25 for movement therewith. The rod 26 is connected to a movable member, such as the lifting arm of a crane or man basket or the shovel assembly of a backhoe or similar machine, and extends outwardly from the cylinder 22. As is well known in the art, the four-way valve 15 is selectively moved so as to cause the piston 25 to move relative to the cylinder 22, thereby moving the member connected to the rod 26.

Figure 2:
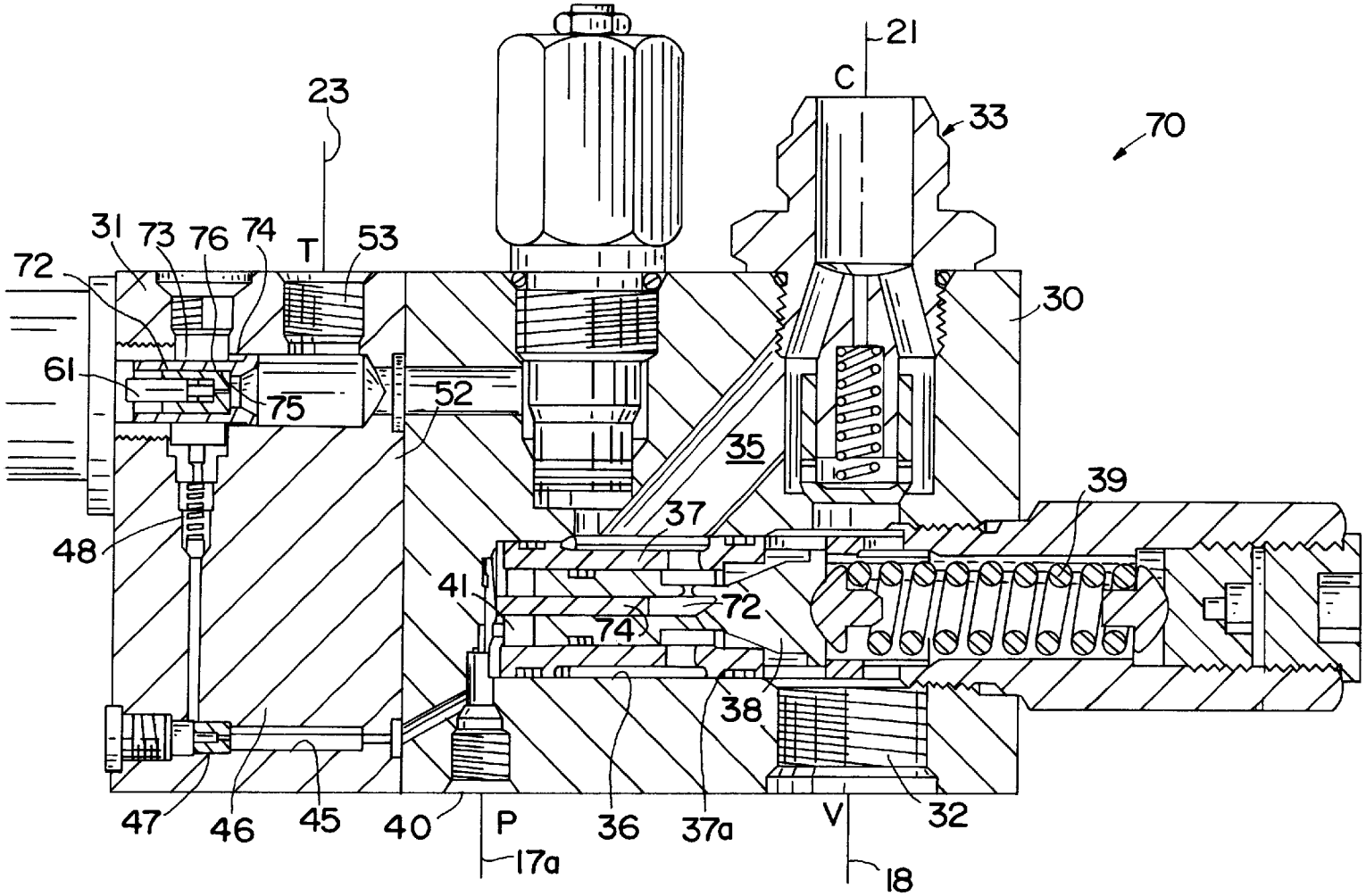
FIG. 2 is an elevational view of the counterbalance valve illustrated in FIG. 1.
Figure 3:
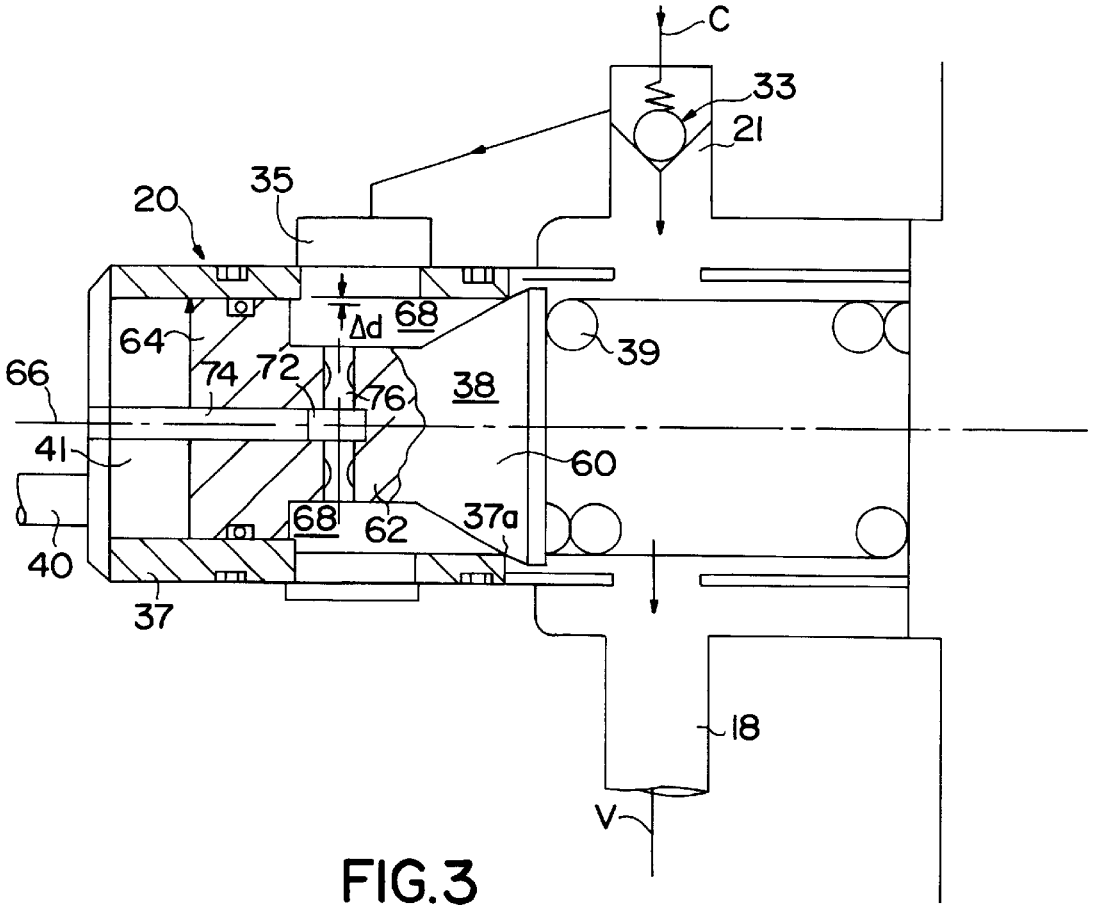
FIG. 3 is an elevational view of a portion of the counterbalance valve of FIG. 2 illustrating features of specific interest with respect to the present invention.

Referring now to FIG. 2 and 3, the structure of the holding valve 20 is illustrated in detail. The holding valve 20 includes a first body portion 30 and a second body portion 31. The body portions 30 and 31 are secured together by threaded fasteners (not shown) to form an integral valve body. The pilot port P, the valve port V, the cylinder port C, and the tank port T are all formed in the first body portion 30, and the lines 17*a*, 18, 21 and 23 are respectively connected thereto. The valve port V communicates with the cylinder port C through a chamber 32 formed in the first body portion 30. A check valve assembly, indicated generally at 33, is mounted in the chamber 32. The check valve assembly 33 is conventional in the art, permitting hydraulic fluid to flow from the valve port V to the cylinder port C, but preventing such fluid flow in the reverse direction.

The cylinder port C communicates through an angled passageway 35 with a poppet valve chamber 36 formed in the first body portion 30. The poppet chamber 36 communicates with the chamber 32. However, a hollow poppet housing 37 is retained within the chamber 36. Within a poppet case 37, a poppet 38 is slidably disposed. A spring 39 is also disposed within the poppet case 37. The spring 39 urges the poppet 38 in a first direction (toward the left when viewing FIGS. 2 and 3) into sealing engagement with a seat 37*a* (see FIG. 3) formed on the poppet case 37. When the poppet 38 engages the seat 37*a* under the urging of the spring 39, fluid communication is prevented between the chamber 36 and the chamber 32. Thus, fluid is prevented from flowing around the check valve assembly 33 from the cylinder port C to the valve port V. Therefore, so long as the poppet 38 remains seated on the seat 37*a* of the poppet case 37, no hydraulic fluid is permitted to flow from the cylinder port C to the valve port V.

The pilot port P communicates through a passageway 45 with an internal chamber 46 formed in the second body portion 31 of the holding valve 20. An orifice plug 47 is disposed in the passageway 45 between the pilot port P and the chamber 46. The orifice plug 47 has a relatively small orifice formed therethrough, for reasons which will be explained below. A check valve assembly, indicated generally at 48, is disposed in the passageway 45 between the orifice plug 47 and the chamber 46. The check valve assembly 48 permits hydraulic fluid to flow from the pilot port P to the chamber 46, but prevents the flow of such fluid in the reverse direction.

2) The Improvement According to the Present Invention

As is best seen in FIG. 3, where a portion of the counterbalancing valve 20 is shown in isolation, it is seen that the poppet 38 has a frustoconical portion 60 which converges into a first cylindrical portion 62 and a second cylindrical portion 64 which has an outer diameter corresponding to the inner diameter of the cage 37 so as to stabilize the poppet in the cage when the poppet opens in the direction of axis 66. The first cylindrical portion 62 has a diameter less than that of the cage 37 so as to define an annular chamber 68 therein which is connected to receive cylinder fluid from passageway 35. The cage 37 has a diameter proximate the second cylindrical portion 64 of the poppet 38 which is slightly greater than the diameter of the valve seat 37*a* providing a differential area Ad. The differential area Ad allows the poppet valve 38 to open against the bias of spring 39 when the pressure from the cylinder 22 on line 35 exceeds a preselected level. Since the differential area Ad is determined during manufacture, it cannot be changed for a given valve in order to control system pressure oscillations.

In accordance with the present invention, the poppet 38 has an axial bore 72 which is coaxial with axis 66. The axial bore 72 receives a rod 74 which is fixed to the valve body housing 30 and extends through the cage 37. A radial bore in 76 in the first cylindrical portion 62 intersects the axial bore so that the axial bore 72 is connected to the annular chamber 68 in the cage 37. Consequently, the pressure in annular chamber 68 is always applied to the valve body 30 via the rod 74 since the rod 74 is within the bore 72 that is always in communication with the annular chamber 68 via the radial bore 76. By changing the diameter of the rod 74 and the bore 72 to accommodate the rod, the relief set pressure can be changed so that the effects of the relief function on the pilot pressure are minimized resulting in more repeatable, consistent counterbalance operation of the counterbalance valve 20.

During normal operation, the pilot pressure on line 40 in chamber 41 controls the amount that the poppet valve 38 opens against the bias of coil spring 39. This invention allows the relief setting and operation to be controlled accurately and reliably in a counterbalance or "holding" valve. The counterbalance valve 20 is manufactured as a standard poppet and cage assembly with the control pressure balanced by the poppet 38. The pilot pressure controls the amount of poppet opening against the bias of spring 39 during normal operation as in a standard counterbalance valve.

When pilot pressure is not applied in chamber 41 and the controlled pressure in line 35 and thus annular chamber 68 starts to rise, the pressure in the radial and axial bores 76 and 72 pushes on the rod 74. The rod 74 pushes on the valve body 31 with no effect. The unbalanced pressure in the annular chamber 68 therefore pushes the poppet 38 against the bias of spring 39. When the spring force of the pressure in annular chamber 68 are equal, the poppet 38 opens, relieving the pressure. Since the hydraulic fluid relieving through the poppet 38 is not the pressure controlling fluid, the relief characteristic of the valve 20 can be controlled for smoother, more stable relief operation. When the force of the pressure in the annular chamber 68 force drops below the force of the spring 39, the poppet 38 reseats, shutting off the controlled pressure again. In the counterbalance mode, the pilot pressure in chamber 41 acts all of the time against the bias of spring 39 only and not against the controlled pressure, thus providing repeatable, consistent operation regardless of the controlled pressure.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A counterbalance valve assembly for use in a hydraulic operating system, the assembly having a valve body with a valve port adapted to receive fluid from and deliver fluid to a control valve, a cylinder port adapted to receive fluid from and deliver fluid to a fluid actuator, a pilot port adapted to receive pilot fluid from and deliver pilot fluid to the control valve, and a tank port adapted to deliver fluid to a reservoir, the counterbalance valve assembly comprising:

a primary check valve assembly for permitting fluid to flow in a first direction from the valve port to the cylinder port of the counterbalancing valve assembly;

a poppet valve assembly for permitting fluid to flow in a second direction from the cylinder port to the valve port of the holding valve assembly, said poppet valve assembly being biased by a spring to a closed position for preventing fluid from flowing therethrough, an open position for permitting fluid to flow therethrough, and intermediate positions for modulating the rate at which fluid flows therethrough, the selection of which being determined by pilot fluid pressure communicated through a first passage in the counterbalance valve assembly from the valve pilot port to said poppet valve assembly; and a passage in the poppet valve assembly for applying fluid pressure from the fluid actuator to the valve body whereby the pilot fluid applies pressure only against the bias of the spring.

2. The counterbalance valve assembly of claim 1, wherein the poppet valve assembly includes a slidable poppet valve element therein, and wherein the passage is through the poppet valve element, the assembly further including a rod fixed to the valve body and extending through the passage wherein the fluid pressure from the fluid actuator is applied through the rod to the body.

3. The counterbalance valve assembly of claim 2, wherein the poppet valve assembly includes a poppet valve cage fixed within the valve body and wherein the poppet valve element is slidably received within the poppet valve cage.

4. A poppet valve assembly useful in a counterbalance valve wherein the poppet valve is mounted in a valve body, the assembly comprising:

a poppet valve cage received with the body, the poppet valve cage having a chamber therein for receiving control fluid, a first chamber therein for receiving pilot fluid, and a second chamber for receiving control fluid;

a poppet valve element slidably disposed in the poppet valve cage, the poppet valve element having first and second ends with the first end being in the first chamber for receiving pilot fluid and the second end engaging a spring which urges the poppet valve element toward the first chamber;

the poppet valve having a passageway therein in communication with the second chamber and having an axially extending passageway; and a rod fixed at one end with respect to the poppet valve and receivable in the axially extending passageway whereby pressure from control fluid in the second chamber is applied by the rod to the valve body so that pressure from the pilot fluid acts only against the bias spring when the valve assembly is in the counterbalance mode.

5. The valve assembly of claim 4, wherein the valve element has a differential area oriented in opposition to the spring, wherein when pressure resulting from the control fluid and acting on the differential area exceeds the force applied by the spring to the poppet valve element, the poppet valve element opens.

6. The valve assembly of claim 5, wherein the rod is anchored to the poppet valve cage.

7. The valve assembly of claim 6, wherein the rod is coaxial with the poppet valve element.

8. The valve assembly of claim 7, wherein the passageway in communication with the second chamber is a radially extending passageway.

9. A counterbalance valve assembly comprising:

a valve block with pilot, control and valve ports connected to a poppet valve chamber;

a poppet valve cage received in the poppet valve chamber, the poppet valve chamber having a fist end and a second end, the first end being open to the pilot port and the second end having a spring in abutment therewith, the poppet valve further having a valve seat therein of a first selected diameter and a cylinder portion of a diameter less than the valve seat which defines a differential area at the valve seat, the poppet valve cage being open to the control port at a location between the first end and valve seat and open to the valve port at a location between the second end and valve seat;

a poppet valve element within the poppet valve cage, the poppet valve element being urged by the spring to seat against the valve seat and having pilot fluid pressure from the pilot port applied in opposition to the spring; the poppet valve element having a control fluid passageway therein in communication with the control port and an axially extending passageway in communication with the control fluid passageway; and a rod fixed with respect to the valve body and extending into the axial passageway wherein the control fluid applies pressure on the rod and through the rod applies its pressure to the valve body.

10. The counterbalance valve of claim 9, wherein the control fluid passageway extends radially with respect to the axial passageway and is constricted.

11. The counterbalance valve of claim 9, wherein the rod is fixed to the first end of the poppet valve cage.

12. The counterbalance valve of claim 11, wherein the rod is detachable from the first end of the cage, wherein the rod is replaceable by a new rod of a different diameter and wherein the axial passageway poppet valve element is alterable to complement the rod of a different diameter by either reboring the passageway or replacing the poppet valve element with an element having an axially extending passageway complementing the new rod.

* * * * *